US012631389B2

(12) United States Patent
Styonavich et al.

(10) Patent No.: US 12,631,389 B2
(45) Date of Patent: May 19, 2026

(54) HIGH EFFICIENCY COLD FINGER

(71) Applicant: L3Harris Technologies, Inc., Melbourne, FL (US)

(72) Inventors: Stephen Max Styonavich, Loveland, OH (US); Christopher Barton, Cincinnati, OH (US); Vincent Lieu, Maineville, OH (US); Uri Bin-Nun, Westford, MA (US)

(73) Assignee: L3Harris Technologies, Inc., Melbourne, FL (US)

( * ) Notice: Subject to any disclaimer, the term of this patent is extended or adjusted under 35 U.S.C. 154(b) by 398 days.

(21) Appl. No.: 18/363,042

(22) Filed: Aug. 1, 2023

(65) Prior Publication Data

US 2024/0077246 A1 Mar. 7, 2024

Related U.S. Application Data

(60) Provisional application No. 63/403,913, filed on Sep. 6, 2022.

(51) Int. Cl.
*F25D 19/00* (2006.01)

(52) U.S. Cl.
CPC ..... *F25D 19/006* (2013.01)

(58) Field of Classification Search
None
See application file for complete search history.

(56) References Cited

U.S. PATENT DOCUMENTS 4,365,982 A * 12/1982 Durenec ..... F25B 9/14 62/6
4,414,824 A * 11/1983 Durenec ..... F25D 19/006 62/51.1
5,727,392 A * 3/1998 Matte ..... F04B 37/08 62/55.5
6,164,077 A 12/2000 Feger
7,137,259 B2 11/2006 O'Baid et al.
7,210,312 B2 5/2007 Unger
8,490,414 B2 * 7/2013 Hon ..... F25B 9/14 60/520
8,910,486 B2 * 12/2014 Bin-Nun ..... F25B 9/14 62/51.2
9,528,744 B2 * 12/2016 Frossati ..... F25D 19/006

(Continued)

*Primary Examiner* — Filip Zec
(74) *Attorney, Agent, or Firm* — Edell, Shapiro & Finnan, LLC

(57) ABSTRACT

Thermal energy transmission from a cryocooler cold finger is enhanced by means of a high thermal conductivity material used for or placed adjacent the cold finger end cap. In addition, the actual or effective surface area contacted by the working gas proximate the endcap is increased, thereby increasing the convective heat transfer coefficient. These features permit the coolest gas expansion space in the cold finger to be provided within the highly thermally conductive end cap, unlike many conventional designs in which the cold finger of low thermally conductive metal forms the expansion space side walls and the endcap forms only the axially facing outer surface in contact with the cooled equipment. Having the expansion space built into the high thermally conductive end cap reduces the temperature drop between the load to be cooled and the gas (e.g., helium), thus increasing the thermodynamic cycle efficiency.

20 Claims, 5 Drawing Sheets

(56) References Cited

U.S. PATENT DOCUMENTS

| | | | | |
|---|---|---|---|---|
| 10,947,962 | B1 * | 3/2021 | Olson | F04B 27/0442 |
| 2010/0050661 | A1 * | 3/2010 | Snow | F25B 9/14 62/51.1 |
| 2014/0202172 | A1 | 7/2014 | Kim | |
| 2016/0273809 | A1 * | 9/2016 | Walter | F25B 9/14 |
| 2022/0057046 | A1 * | 2/2022 | Dessau | F25B 9/10 |
| 2022/0116525 | A1 * | 4/2022 | Sprafke | H04N 23/52 |
| 2022/0163400 | A1 * | 5/2022 | Park | G01K 7/34 |
| 2022/0325922 | A1 * | 10/2022 | Tanchon | F25B 9/145 |
| 2023/0288103 | A1 * | 9/2023 | Conrad | F25B 9/14 |
| 2024/0027708 | A1 * | 1/2024 | Lunsman | H05K 7/20636 |
| 2024/0042451 | A1 * | 2/2024 | Lopez Dias | F25D 19/00 |

* cited by examiner

HIGH EFFICIENCY COLD FINGER

CROSS-REFERENCE TO RELATED APPLICATION

This application is a non-provisional application claiming priority from U.S. Provisional Application No. 63/403,913 entitled "High Efficiency Cold Finger", and filed Sep. 6, 2022, the entire disclosure in which is incorporated in its entirety herein by this reference.

TECHNICAL FIELD

The present invention pertains to methods and apparatus for increasing cooling capacity and efficiency of cryocoolers by means of improvements in cold finger structures.

BACKGROUND

Cryocoolers are often used to cool various types of equipment to cryogenic temperatures to permit the cooled equipment to function properly. An example of such a cryocooler is disclosed in US 2014/0202172 (Kim), the entire disclosure in which is incorporated herein by reference. For example, many infrared camera or sensor assemblies operate most efficiently and reliably when cooled to cryogenic temperatures, such as approximately the boiling point of liquid nitrogen, 77° K, and are typically operated in a vacuum to provide thermal insulation and avoid condensation on the sensor. Cryocoolers typically deliver the required low temperature by means of a cold finger comprising a generally cylindrical thin-walled tubular housing of material with low thermal conductivity such as titanium or stainless steel having a warm proximal end and a cold distal tip. The cooled distal tip is configured to be placed in contact with equipment to be cooled. A displacer is caused to oscillate back and forth within the tube, thermodynamically cycling a working gas (e.g., helium) between the warm and cold ends in alternating states of compression and expansion such that the expansion causes the cooled gas to cool the cold finger end cap. Examples of cold fingers may be seen in the aforementioned US 2014/0202172 (Kim) document, as well as in the following patent documents, the disclosures of which are incorporated herein by reference in their entireties: U.S. Pat. No. 7,137,259 (O'Baid et al.); U.S. Pat. No. 7,210,312 Unger); and U.S. Pat. No. 6,164,077 (Feger).

As more complex and higher performance equipment is developed (e.g., improved infrared cameras or sensors), greater cooling capacity is often required of cryocoolers. A limiting aspect of conventional cryocoolors resides in the cold finger assemblies which are typically made from materials that have low thermal conductivity. More particularly, most cold finger tubes are made from a metal having a low thermal conductivity to prevent thermal losses along the axial length of the tube.

The cold finger end cap is typically formed integrally with, and from the same low thermal conductivity material as, the tube, thus limiting the effectiveness of the end cap in transferring cold temperatures to the equipment to be cooled. Alternatively, the end cap may be made as a separate piece that is welded or brazed to the tube; however, in order to avoid the problems associated with joining dissimilar metals, the end cap material is typically made from the same or similar material as the tube. In either case, the low thermal conductivity of the end cap material seriously limits the capacity and efficiency of transferring the cold temperatures to the equipment to be cooled.

Presented herein is a disclosure of a cold finger of simple design that provides a multifold increase in the efficiency and capacity of transferring cold temperatures from the cold finger to equipment to be cooled.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The embodiments of the present disclosure each take advantage of the fact that the distal end of a cold finger, proximate the end cap, is where the internal working gas is coldest. Accordingly, the embodiments focus on modifications to the material and/or structure of prior end caps that permit increased transfer of the cold temperature to the cold finger load. More specifically, the embodiments involve a focused approach to dissimilar material joining, material selection, and cold tip configuration to provide an improved cold finger.

In one embodiment a high thermal conductivity material is used for the end cap, placed adjacent the end cap, or both. In other embodiments the actual or effective surface area contacted by the working gas proximate the endcap is increased, thereby increasing the convective heat transfer coefficient between the working gas and the end cap. These embodiments may be used individually or in combination to increase the efficiency of the transfer of the cold temperature energy to the cold finger load. Functionally, these embodiments permit the cooler gas expansion space to be provided within the highly thermally conductive end cap, unlike many conventional designs in which a low thermally conductive metal forms the expansion space side walls and the high thermally conductive material forms only the axially facing outer surface in contact with the equipment to be cooled. Having the expansion space built into the high thermally conductive end cap reduces the temperature drop between the load to be cooled and the gas (e.g., helium), thus increasing the thermodynamic cycle efficiency. This is especially important and critical when high cooling capacity is required, for example, for large format detectors.

In one embodiment the end cap material is Aluminum Nitride (AlN), particularly but not necessarily in wurtzite phase, which is a ceramic material of sufficiently high thermal conductivity to efficiently transfer the cold energy from the working gas to the load. It is to be understood that such Aluminum Nitride ceramic is merely one example of a material with sufficiently high thermal conductivity for the purposes described herein. A few others of the many examples are, without limitation, or alumina ($Al_2O_3$), Molybdenum and alloys thereof and Beryllium Oxide (BeO).

A key hurdle preventing use of high thermal conductivity material in prior art cold finger cold tips or end caps is the dissimilarity between such materials (e.g., AN) and the Titanium, Inconel 718, stainless steel, or other low thermal conductivity material of the cold finger tube; that is, attempts to join these materials of dissimilar coefficients of thermal expansion result in unreliable joints or junctions between the materials, particularly for use under extreme temperature conditions. The graded seal approach used in some of the embodiments of the present disclosure overcomes these material joining issues.

Another feature of this disclosure is an increase of the surface area of the high thermal conductivity end cap material by, for example, extending it coaxially along the distal end of the cold finger tube interior surface. This increased surface area extends along the coldest portion of the tube and thereby provides greater cold temperature transfer capacity for the cold finger. Thus, in addition to axially extending the tube sidewall with the higher thermal conductivity end cap, the interior surface of the end cap may be machined or otherwise contoured to provide greater surface area for contact with the working gas. To achieve even greater cooling capacity, a mesh porous high thermal conductivity material, (e.g., AlN ceramic, alumina, BeO, etc.) may be provided in contact with the end cap interior surface, for example by being sintered in place inside the non-porous end cap. The mesh or porous high thermal conductivity material increases the effective convective heat transfer coefficient between the working gas (e.g., helium) and the porous walls of the expansion space.

These and other advantages and features will become evident in view of the drawings and detailed description.

The above and still further features and advantages of the present invention will become apparent upon consideration of the definitions, descriptions and descriptive figures of specific embodiments thereof set forth herein. In the detailed description below, like reference numerals in the various figures are utilized to designate like components and elements, and like terms are used to refer to similar or corresponding elements in the several embodiments. While these descriptions go into specific details of the invention, it is understood that variations may and do exist and would be apparent to those skilled in the art in view of the following description.

BRIEF DESCRIPTION OF THE DRAWINGS

By way of example, specific illustrative embodiments of the present disclosure will now be described with reference to the accompanying drawings, in which.

DETAILED DESCRIPTION

Figure 1:
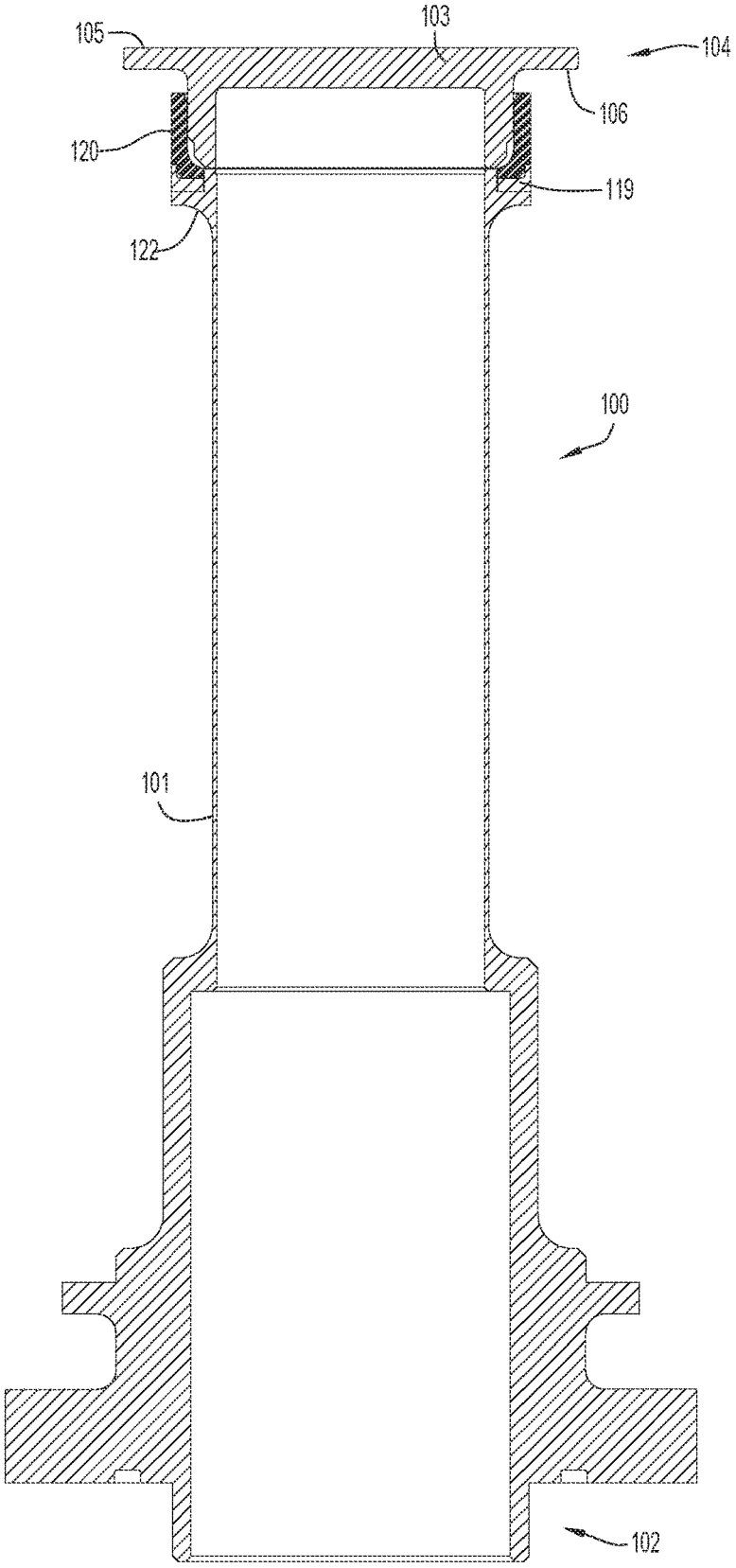
FIG. 1 is a view in longitudinal section of an improved cold finger according to one embodiment the present disclosure with the interior displacer mechanism removed for purposes of clarity.

The present systems and methods are described more fully hereinafter with reference to the accompanying drawings, in which several exemplary embodiments are shown. It will be readily understood that the components of the embodiments as generally described herein and illustrated in the appended drawings may be arranged and designed in a wide variety of different configurations. Thus, the following more detailed description of various embodiments, as represented in the drawings, is not intended to limit the scope of the present disclosure but is merely representative of various embodiments. While the various aspects of the embodiments are presented in the drawings, the drawings are not drawn to scale unless specifically indicated.

The subject matter disclosed herein may be embodied in other specific forms without departing from its spirit or essential characteristics; that is, the described embodiments are to be considered in all respects only as illustrative and not restrictive. The scope of the invention(s) is/are, therefore, indicated by the appended claims rather than by this detailed description. All changes that come within the meaning and range of equivalency of the claims are to be embraced within their scope.

Reference throughout this specification to features, advantages, or similar language does not imply that all the features and advantages that may be realized with the disclosed apparatus, system and method should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the disclosed systems may be combined in any suitable manner in one or more embodiments. One skilled in the relevant art will recognize, in light of the description herein, that the embodiments can be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

For purposes of the disclosure and claims herein, the following terms shall have the meanings indicated immediately below.

(a) The terms "axial", "axially", and variations thereof mean or refer to the central longitudinal axis of the cold finger.

(b) The terms "radial", "radially" and variations thereof mean or refer to the radial direction extending from and perpendicular to the central longitudinal axis of the cold finger.

(c) The terms "annular", "annularly" and variations thereof mean or refer to the rotational direction about the central longitudinal axis of the cold finger.

(d) The terms "distal", "distally" and variations thereof mean or refer to a direction toward the cold end of the cold finger.

(e) The terms "proximal", "proximally" and variations thereof mean or refer to a direction toward the warm end of the cold finger.

Figure 2:
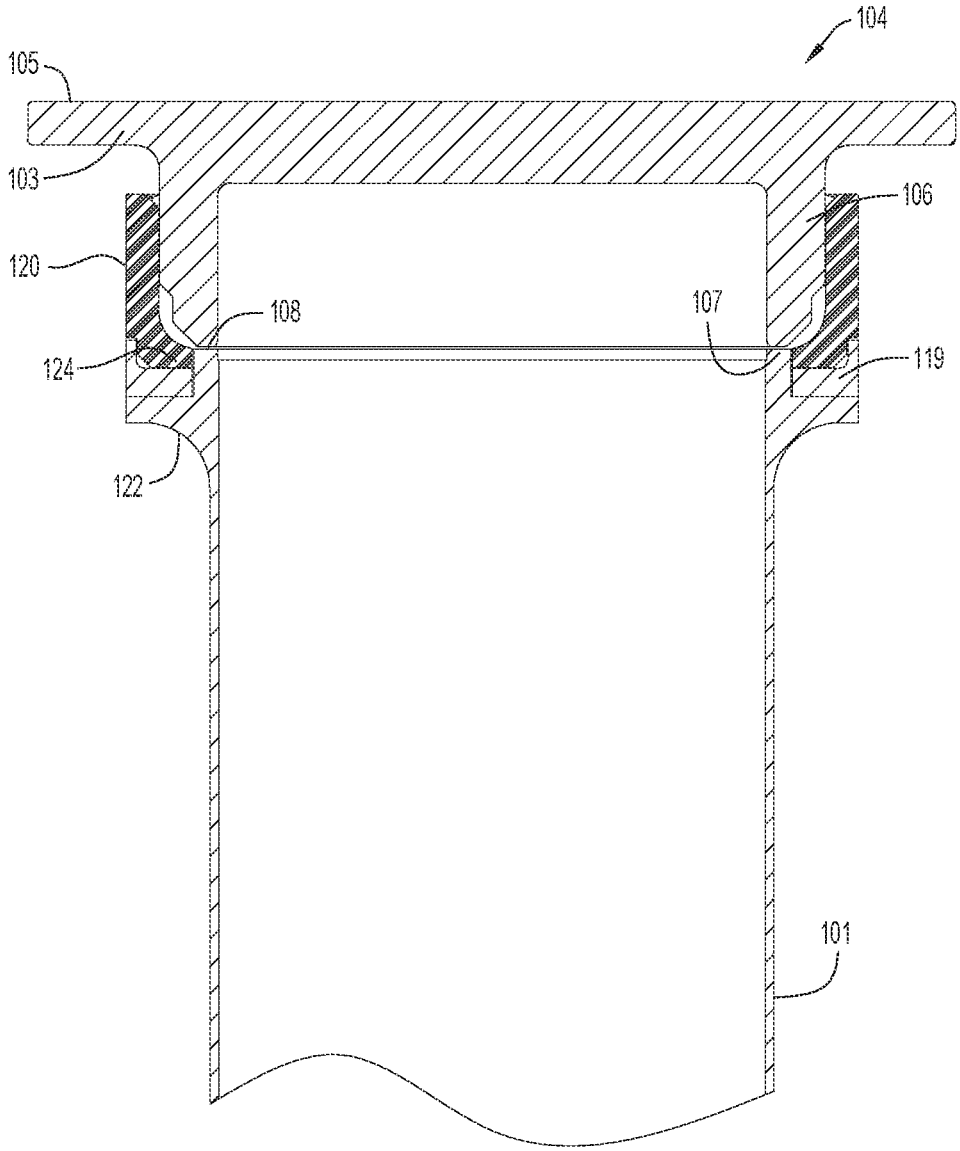
FIG. 2 is a detail view in section of the end cap of the cold finger of FIG. 1.

Referring specifically to FIGS. 1 and 2, a cold finger 100 includes a generally cylindrical thin-walled housing tube 101 having a relatively warm proximal end 102 and a distal cold temperature transfer end closed by an end cap 104 for contacting equipment to be cooled. A support flange 122 surrounds and extends radially outward from the outer wall of tube 101 at a location slightly proximally displaced from the distal end 108 of the tube, leaving a short stub end portion of tube 101 extending between flange 122 and the distal end of the tube. Conventional working gas cooling components of the cold finger are typically located within housing tube 101 but form no part of the concepts disclosed herein and are omitted from the drawings to facilitate clarity and understanding of those concepts. End cap 104 includes an axially short platform portion 103 having a substantially flat distally facing outer surface 105 configured to contact equipment to be cooled. A hollow cylinder portion 106 of the end cap projects proximally from the underside of the platform portion 103 and terminates in an annular edge 107. Tube 101 is made from a strong metal (e.g., titanium) or alloy (e.g., Inconel 718) having a low thermal conductivity to minimize thermal loss along the axial length of the tube. End cap 104 is made from a high thermal conductivity material such as, and by way of example only, Aluminum Nitride (particularly but necessarily in wurtzite phase), Alumina, Beryllium Oxide (BeO), and Molybdenum.

When considering thermal conductivity for purposes of this disclosure, it is to be noted that thermal conductivity varies as a function of temperature, and it is important that the material chosen for the end cap has a high thermal conductivity at cryogenic temperatures. For example, it is preferred that the end cap material have a thermal conductivity equal to or greater than 80 W/m-K (Watts per meter-Kelvin) at a temperature of 77.36K. As a practical matter, the end cap material(s) should have a thermal conductivity at cryogenic temperatures that is not significantly lower, and preferably equal to or higher, than that of Molybdenum which has a thermal conductivity on the order of more than five times that of titanium, the low thermally conductive material of tube 101.

As best viewed in FIG. 2, the annular proximally facing edge 107 of cylinder portion 106 and the annular distal edge 108 of tube 101 are of substantially equal inside diameter such that when those edges are placed in abutting planar contact, as shown, the interior surface of cylinder portion 106 of the end cap forms a continuation of the cylindrical interior surface of tube 101. The endcap and tube, made of materials which are dissimilar and which have disparate coefficients of thermal expansion, are joined at these abutting surfaces in a compression joint secured by a graded seal. For this purpose, there is provided an annular collar 120 of material (e.g., INVAR) having a low coefficient of thermal expansion that substantially matches that of the end cap material. For present purposes, materials having substantially matching coefficients of thermal expansion may be joined by conventional means (e.g., brazing, welding, adhesives, etc.) without separating due to thermal expansion or contraction when exposed to temperatures experienced in normal operation of the cold finger disclosed herein; whereas, conventionally joined materials having disparate coefficients of thermal experience are likely to separate under such conditions.

Collar 120 has an open distal end and a cylindrical inner surface substantially abutting and surrounding the outer surface of cylinder portion 106 of the endcap. The proximal end of the collar is defined by an annular lip 124 projecting a short distance radially inward. Lip 124 has a proximally facing flat annular end surface that abuts a distally facing and radially extending flat surface of a thin ring 119 that coaxially surrounds and contacts the outer surface of the stub end portion of tube 101. The proximally facing surface of ring 119 abuts the distally facing surface of the support flange. Thusly located, ring 119 is positioned between and axially separates collar 120 and tube flange 122.

Ring 119 may be formed of the same material as tube 101, e.g., titanium, or other suitable material such as Inconel 718. INVAR is particularly suitable for the collar material because its coefficient of thermal expansion closely matches that of the of end cap material (e.g., Aluminum Nitride) and therefore facilitates joining (e.g., by brazing, welding, soldering, etc.) of the end cap and collar.

In manufacturing the cold finger of FIGS. 1 and 2, the collar 120 is secured to ring 119 by joining (by brazing, welding, soldering or the like) the proximally facing annular end surface of collar lip 124 to the distally facing surface of ring 119. The resulting one-piece unit concentrically receives and is then joined (e.g., by brazing, welding, soldering, adhesive, etc.) to the outer surface of the proximally extending cylinder portion 106 of the end cap. The subassembly comprising end cap 104, collar 120 and ring 119 is then axially slid over the short annular stub portion at the distal end of tube 101 to bring the proximally facing surface of ring 119 into abutment with the distally facing surface of flange 122 with the inner surface of ring 119 proximate the outer surface of the stub portion. Because ring 119 and tube 101 are made of the same or similar material, their abutting facing surfaces are easily joined together by conventional laser welding or other known processes.

During operation, the volume defined interiorly of end cap cylinder portion 106 and platform portion 103 constitutes the coldest region of the cold finger, and its highly thermally conductive material efficiently transfers cold temperatures from the end cap 104 to the equipment being cooled. Stated otherwise, cylindrical portion 106 longitudinally extends the inside of tube 101 with highly thermally conductive material in the coldest region of the cold finger to thereby capture the highest energy available and enhance the thermal energy transfer capacity of cold finger 100.

Figure 3:
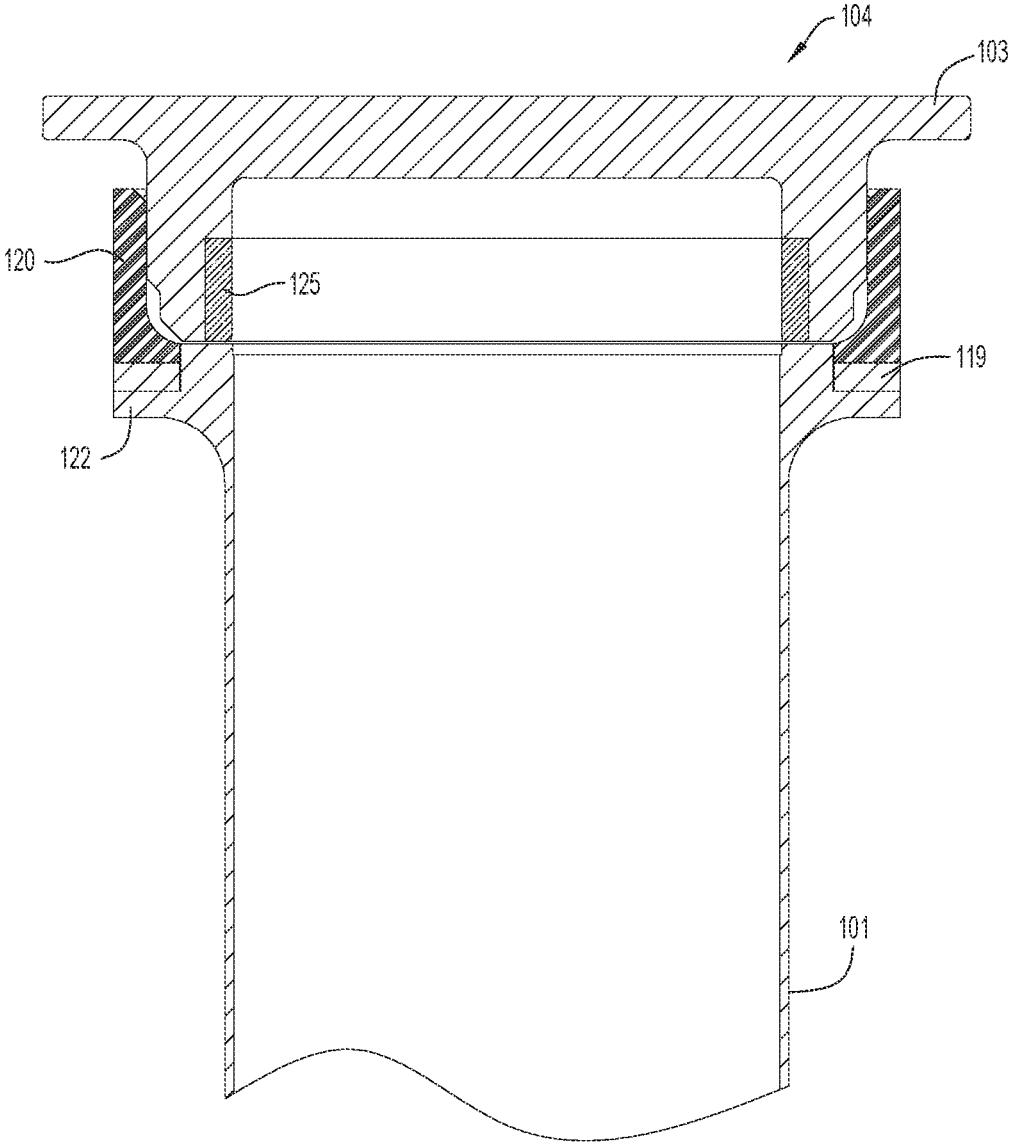
FIG. 3 is a detail view in section of an end cap according to another embodiment of the present disclosure.

In the embodiment shown in FIG. 3, the interior wall of cylinder portion 106 of the end cap is provided with an interior sintered lining 125 of porous or mesh aluminum nitride to increase the surface area of AlN material that is contacted by the cold working gas, thereby further increasing the capacity and efficiency of transferring cold temperatures from the working gas to the cooled equipment via the end cap 104. As shown, the interior surface of the cylinder wall 106 may be provided with an annular recess 126 configured to receive lining 125. It should be noted that lining 125 need not be porous but instead may be solid and made of a high thermally conductive material. Alternatively, or in addition, the interior wall may have regular or irregular recesses machined or otherwise defined therein to increase the effective surface area in contact with the working gas, thereby increasing the convective heat transfer coefficient, to aid in cold temperature transfer.

The mesh or porous ceramic material increases the convective heat transfer coefficient between the working gas (e.g., helium) and the expansion space porous walls. The increase in the convective heat transfer coefficient is achieved by increasing the gas velocity of gas flowing around the media particles. More specifically, the working gas flows in and out of the porous ring, thus transferring thermal energy from the walls when pressure is low and inserting the colder gas (at lower thermal energy) into the porous walls. In addition to the increase in the convective heat transfer coefficient, the structure surface area increases as well by as much as ten times, which reduces the total thermal impedance between the gas and the thermal load.

Figure 4:
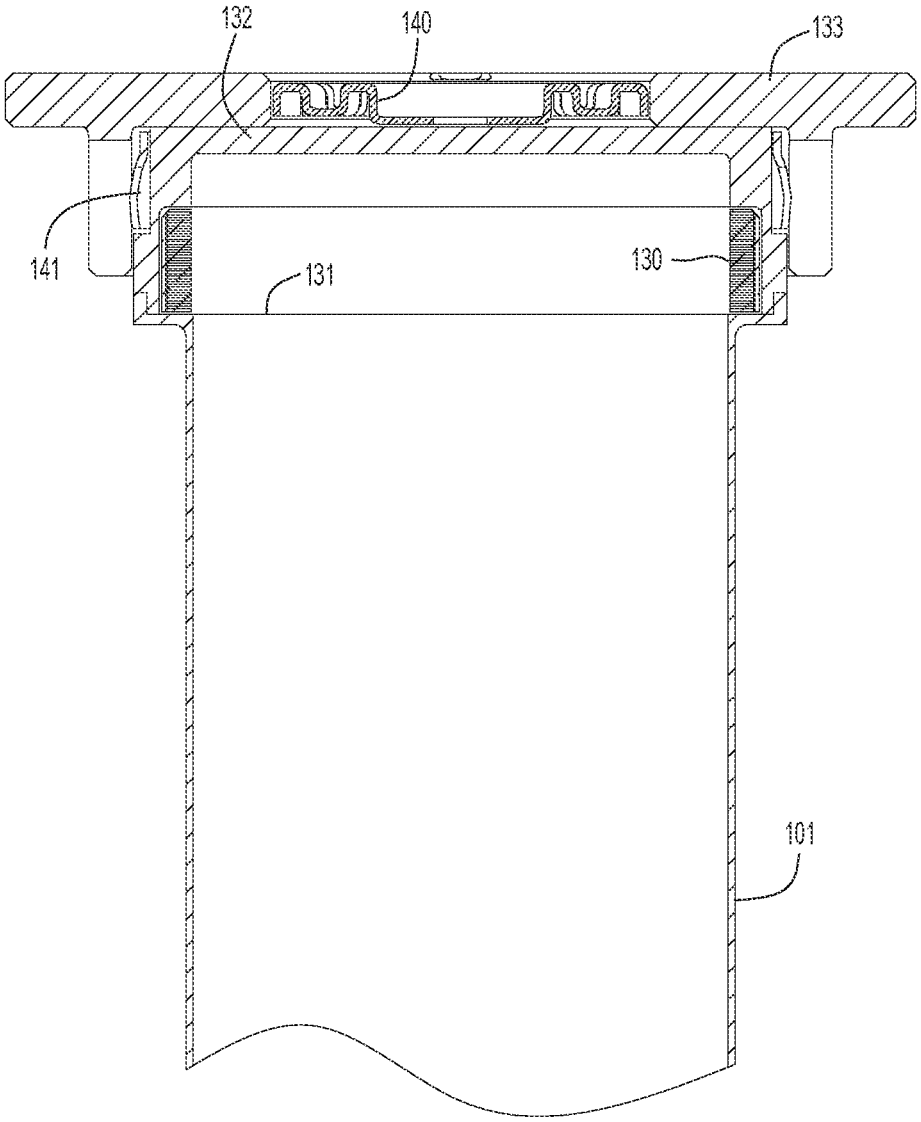
FIG. 4 is a detail view in section of an end cap according to a further embodiment of the present disclosure.

In the embodiment of FIG. 4, the distal end of the tube 101 is provided with a radially expanded distal end forming an annular channel 131 in which a sleeve 130 may be secured. Sleeve 130, if provided, is formed from a high thermal conductivity material. The end cap is comprised of two primary pieces: an interior cap 132 of a low thermal conductivity material that is the same as or similar to the material (e.g., titanium) of tube 101, thereby permitting it to be readily joined to tube 101 by welding, or the like; and a ceramic outer cap 133 which may be soldered or adhesively bonded or otherwise joined to the outer surface of the expanded region defining channel 131. This configuration isolates the ceramic outer cap material from the high-pressure working gas in tube 101. Outer cap 133 may be provided with a compartment or recess containing copper pieces or other high thermally conductive material 140 to improve thermal energy transmission between the cap 133 and the working gas. In addition, the interior surface of end cap 133 may have grooves or other deformities 141 to increase the effective surface area and thermal energy transmission.

Figure 5:
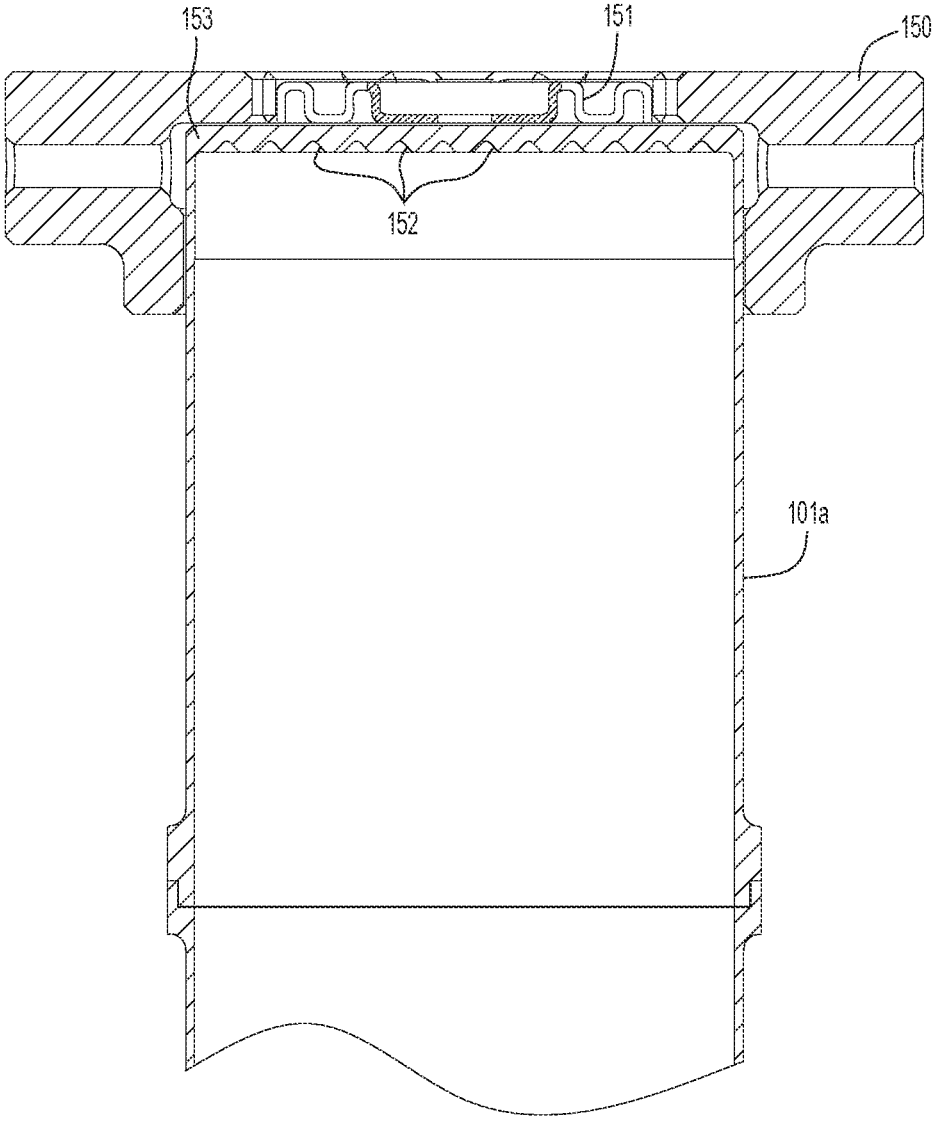
FIG. 5 is a detail view section of an end cap according to still another embodiment of the present disclosure.

Referring to FIG. 5, an end cap 150 of high thermal conductivity material is secured directly to the closed distal end 153 of cold finger tube 101*a* and includes a compartment or recess containing copper pieces or other high thermally conductive material 151 to improve thermal energy transmission between the end cap 150 and the working gas. In addition, or alternatively, the interior surface of the closed end wall 153 may be contoured with recesses or ridges 152 to increase the surface area of the wall and thereby enhance thermal energy transmission from the cold finger.

It should be noted that whether or not the end cap 104 is made high thermally conductive material, the addition of the interior layers/linings of porous AlN material, and/or the machining or otherwise configuring the surfaces exposed to the working gas proximate the distal end of the cold finger tube, significantly increases the capacity of cool temperature transfer from the cold finger. Accordingly, providing those features independently of a high thermal conductivity end cap material constitutes an aspect of the invention disclosed herein.

Thus, in one sense, the principles of this disclosure comprise providing a high thermal conductivity material at the distal of cold finger to enhance the transfer of cold temperature from the working gas to the equipment being cooled at the cold finger end cap. The high thermal conductivity material may be the material of the end cap extended to form the distal end of the cold finger tube, and/or a porous layer of such material secured to the inner surface of the tube or end cap. In preferred embodiments the high thermal conductivity material is aluminum nitride. The principles also comprise machining or otherwise configuring surfaces to increase their area in order to more effectively transfer cold temperature energy from the working gas to the cold finger load.

Although only a number of examples have been disclosed herein, other alternatives, modifications, uses and/or equivalents thereof are possible, and the scope of the present disclosure should not be limited by the particular examples disclosed herein.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A cold finger for use in cryogenically cooling equipment comprising:

a tube of low thermal conductivity material having a distal end and a proximal end and configured to contain a thermodynamically cycled working gas; and an end cap secured to and in direct contact with the distal end of the tube and comprising a material having a substantially higher thermal conductivity than the tube material.

2. The cold finger of claim 1 wherein the tube and end cap materials have disparate coefficients of thermal expansion.

3. The cold finger of claim 2 wherein the entire end cap is comprised of the higher thermal conductivity material, and further comprising a graded seal securing the end cap to the distal end of the tube.

4. The cold finger of claim 3 wherein the graded seal comprises a collar surrounding a portion of the end cap proximate the distal end of the tube, said collar being comprised of a material having a coefficient of thermal expansion that substantially matches the coefficient of thermal expansion of the end cap.

5. The cold finger of claim 4 wherein the graded seal further comprises a ring surrounding the tube and axially interposed between the collar and a flange extending radially outward from the tube, wherein the ring is comprised of a material having a coefficient of thermal expansion closely matching that of the tube material.

6. The cold finger of claim 5 wherein the tube material is titanium or Inconel 718, the collar material is INVAR, and the end cap material is aluminum nitride or alumina.

7. The cold finger of claim 1 wherein said higher thermal conductivity material has a thermal conductivity equal to or greater than 80 W/m-K at a temperature of 77.36K.

8. The cold finger of claim 7 further comprising a lining of the higher thermal conductivity material disposed in contact with the end cap and positioned to be thermally exposed to the working gas at the distal end of the tube.

9. The cold finger of claim 8 wherein the lining material is porous to the working gas.

10. The cold finger of claim 2 wherein the end cap has a recess or compartment defined therein containing the higher thermally conductive material.

11. The cold finger of claim 2 wherein the end cap has recesses defined in an interior surface thereof to increase the surface area exposed to the working gas.

12. The cold finger of claim 1:

wherein the entire end cap is comprised of the higher thermal conductivity material, and further comprising a graded seal securing the end cap to the distal end of the tube, the graded seal comprising:

a collar surrounding a portion of the end cap proximate the distal end of the tube, said collar being comprised of a material having a coefficient of thermal expansion that substantially matches the coefficient of thermal expansion of the end cap; and a ring surrounding the tube and axially interposed between the collar and a flange extending radially outward from the tube, wherein the ring is comprised of a material having a coefficient of thermal expansion closely matching that of the tube material.

13. The cold finger of claim 12 wherein the tube material is titanium or Inconel 718, the collar material is INVAR, and the end cap material is aluminum nitride or alumina.

14. The cold finger of claim 1 wherein the endcap material is selected from the group consisting of aluminum nitride in wurtzite phase, alumina, beryllium oxide and molybdenum.

15. The cold finger of claim 1 wherein the endcap comprises:

a platform portion of relatively short axial length having a distally facing outer surface configured to contact equipment to be cooled and a proximally facing underside; and a hollow portion projecting proximally from the underside of the platform to directly contact the distal end of the tube.

16. The cold finger of claim 15:

wherein the hollow portion of the end cap has a cylindrical interior surface;

wherein the distal end of the tube has a cylindrical exterior surface; and wherein the cylindrical exterior surface of the tube is received in and is in direct contact with the cylindrical interior surface of the endcap.

17. The cold finger of claim 16 wherein the distal end of the tube comprises a closed end wall having an proximally facing interior surface contoured with recesses configured to increase the surface area of the interior surface and thereby enhance thermal energy transmission from the cold finger.

18. The cold finger of claim 17 wherein the end cap includes a compartment or recess containing high thermally conductive material configured to improve thermal energy transmission between the end cap and the working gas in the tube.

19. The cold finger of claim 16 wherein the end cap includes a compartment or recess containing high thermally conductive material configured to improve thermal energy transmission between the end cap and the working gas in the tube.

20. The cold finger of claim 15 wherein the end cap includes a compartment or recess containing high thermally conductive material configured to improve thermal energy transmission between the end cap 150 and the working gas in the tube.

* * * * *